US005555705A

United States Patent [19]

Balcombe

[11] Patent Number: 5,555,705

[45] **Date of Patent: * Sep. 17, 1996**

[54] METHOD OF FILLING AND SEALING A DEFORMABLE CONTAINER

[75] Inventor: Roy Balcombe, Westminister, Calif.

[73] Assignee: Kal Kan Foods, Inc., Vernon, Calif.

[ * ] Notice: The term of this patent shall not extend beyond the expiration date of Pat. No. 5,428,943.

[21] Appl. No.: 438,777

[22] Filed: May 11, 1995

Related U.S. Application Data

[63] Continuation of Ser. No. 768,351, Sep. 30, 1991, Pat. No. 5,428,943, which is a continuation of Ser. No. 517,422, May 1, 1990, abandoned, which is a continuation of Ser. No. 244,829, Sep. 14, 1988, abandoned.

[51] Int. Cl.[6] ..... B65B 31/02; B65B 61/24

[52] U.S. Cl. ..... 53/432; 53/433; 426/111; 426/413

[58] Field of Search ..... 53/407, 432, 433, 53/471, 86, 110, 510, 511; 426/111, 118, 395, 413

[56] References Cited

U.S. PATENT DOCUMENTS

| | | | |
|---|---|---|---|
| 2,124,959 | 7/1938 | Vogel . | |
| 2,768,487 | 10/1956 | Day et al. | 53/433 |
| 3,103,089 | 9/1963 | Allen . | |
| 3,104,506 | 9/1963 | Rohdin | 53/433 |
| 3,289,383 | 12/1966 | Foss | 53/110 X |
| 3,351,265 | 11/1967 | Miller . | |
| 3,360,382 | 12/1967 | Miller | 53/432 X |
| 3,492,773 | 2/1970 | Bergstrom | 53/433 |
| 4,009,552 | 3/1977 | Schlachter | 53/86 |
| 4,472,924 | 9/1984 | Vogele et al. | 53/511 |
| 4,791,775 | 12/1988 | Raque et al. | 53/510 |
| 5,428,943 | 7/1995 | Balcombe | 53/433 X |

FOREIGN PATENT DOCUMENTS

| | | |
|---|---|---|
| 0251877 | 1/1988 | European Pat. Off. . |
| 1547599 | 11/1968 | France . |

*Primary Examiner*—Horace M. Culver
*Attorney, Agent, or Firm*—Curtis, Morris, & Safford

[57] ABSTRACT

A method of filling and sealing a package with a product wherein a container having a bottom generally deformable in shape is filled with a product having a volume less than the container volume but equal to the filled volume. A continuous top lid is placed onto the container and positioned adjacent to a sealing surface and rim section of the container. In this position enough headspace exists to permit the proper lid placement without squeezing product onto the seal surface. The filled container supported on an anvil and lid are then transferred into a vacuum chamber within the vacuum chamber and with a sealing head disposed above the anvil in the raised position, the pressure within the chamber is evacuated by a vacuum. This process lowers the pressure of the headspace gas from the container to that of the chamber. When the desired vacuum level is achieved, the sealing head is lowered and the lid is sealed to the sealing surface of the container. The container is then removed from the vacuum chamber and is brought back to atmospheric pressure, and as a result thereof, the bottom is inverted upwardly thereby forcing the product to fill the headspace voids.

2 Claims, 4 Drawing Sheets

FIG. 5
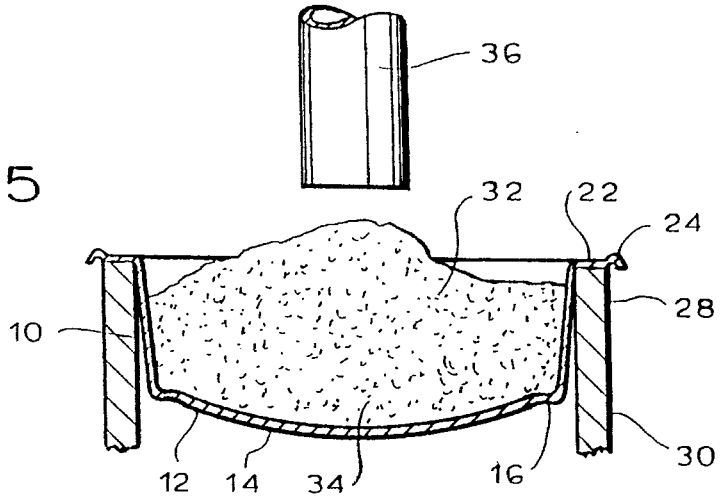
FIG. 6
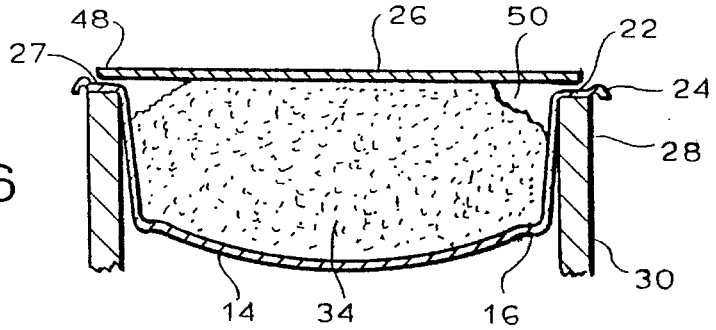
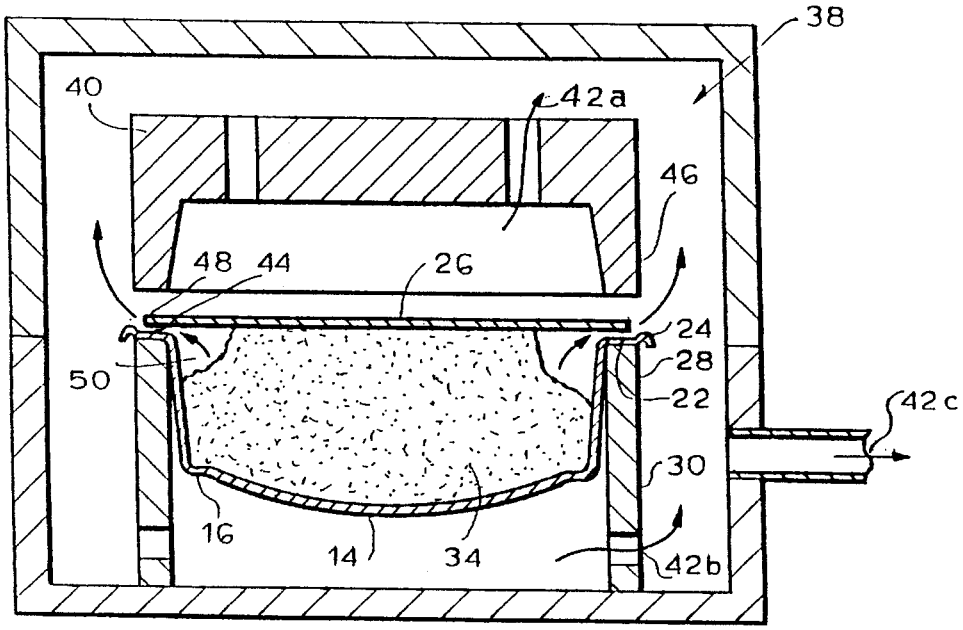
FIG. 7

METHOD OF FILLING AND SEALING A DEFORMABLE CONTAINER

This application is continuation of application Ser. No. 07/768,351, filed Sep. 30, 1991, now issued as U.S. Pat. No. 5,428,943, which is a continuation of application Ser. No. 07/517,422, filed May 1, 1990, now abandoned, which is a continuation of application Ser. No. 07/244,829, filed Sep. 14, 1988, now abandoned.

BACKGROUND OF THE INVENTION

This invention relates to a method of filling and sealing a container with a product, and more particularly, to a method of producing a package in which the integrity of the seal is preserved and voids within the container are virtually eliminated.

Prior methods for filling and sealing a container have provided a substantial "headspace" within the container in order that the seal area of the container is not contaminated with the product, which will result in incomplete and leaking seals.

This headspace gas hinders exploitation of sterilizable containers, because of the difficulty of accurately controlling the pressure within the containers during temperature changes, to ensure the seals are not ruptured or containers otherwise deformed or damaged. If the headspace gas is air, this will cause spoilage of oxygen-sensitive products.

This headspace also has the appearance of a partially filled container, giving a poor value impression to the consumer.

Additionally, the headspace allows movement of product during shipment, resulting in stressing of the lid material (which may rupture), and also damage to the product.

It is well known to use a diaphragm of stretchable lid material to close a container which is deformed to eliminate headspace. This stretchable lid material, however, typically is not puncture resistant and, hence, requires some secondary protection to maximize quality control of the product.

OBJECTS OF THE INVENTION

It is a general object of this invention to provide an improved method of filling and sealing a package with a product.

It is also an object of this invention to provide a method of producing an extended package in which the integrity of the seal of the lid is preserved and the voids within the container that allow product movement are eliminated.

It is another object of this invention to provide a method for filling and sealing a container which does not require that a diaphragm or flexible lid be used in addition to the seal to close a container body.

It is a further object of this invention to provide a method for filling and sealing a container which not only reduces seal area contamination but also increases value impression.

It is another object of this invention to provide a method for filling and sealing a deformable container which enables the fill volume of the container to be less than the initial container volume to thereby isolate the product from the seal area and avoid seal area contamination.

It is still and further object of this invention to provide a retortable container which allows for shorter cooking time.

Other objects and advantages of the invention will become apparent from the detailed description and from the appended drawings in which like numbers have been used to designate like parts in the several views.

SUMMARY OF THE INVENTION

This invention relates to a method of filling and sealing a package with a product, and more particularly to a method of producing a sterilized package in which the integrity of the seal and the lid is preserved and the voids within the container that allow product movement are eliminated. The container of the present invention is designed with a base having a deformable or drawable insert and with the correct ratio of wall strength to the radius of curvature so that the bottom is stable in either the up or down position. The whole container is made of a semi-rigid material, and hence, the bottom is not a stretchable diaphragm. The use of laminations of thermoplastic foil, thin aluminum or steel enables the container to be puncture resistant and provides for considerable resistance to damage in handling and transportation.

In operation, the container is filled with the base in its downward position so that the charging product falls below the seal surface. Thus, there is sufficient headspace to permit the lid placement without squeezing product onto the seal surface. The edge of a top cut lid is then positioned adjacent to a rim section of the container. The filled container and lid are then transferred into a vacuum chamber with the sealing surface of the container being supported on an anvil. The gas in the vacuum chamber is then evacuated. In this position, a sealing head above the container is in a raised position. This process lowers the pressure of the headspace gas within the container to that of the chamber. When the desired vacuum level is achieved the sealing head is lowered and the lid is sealed to the container. Subsequent thereto, the chamber is brought back to atmospheric pressure such that the base is inverted thereby forcing the product to move upwardly to fill the headspace or voids within the container.

As such, this method to fill and seal a container enables the fill volume to be less than the initial container volume to thereby isolate the product from the seal area to avoid seal area contamination. In addition, this process eliminates the voids within the container which allow product movement.

BRIEF DESCRIPTION OF THE DRAWINGS

The following detailed description, given by way of example, but not intended to limit the invention solely to the specific embodiments described, may best be understood in conjunction with the accompanying drawing's in which:

FIGS. 5–9 illustrate a preferred method of filling and sealing a deformable container.

DETAILED DESCRIPTION OF PREFERRED EMBODIMENT

Figure 1:
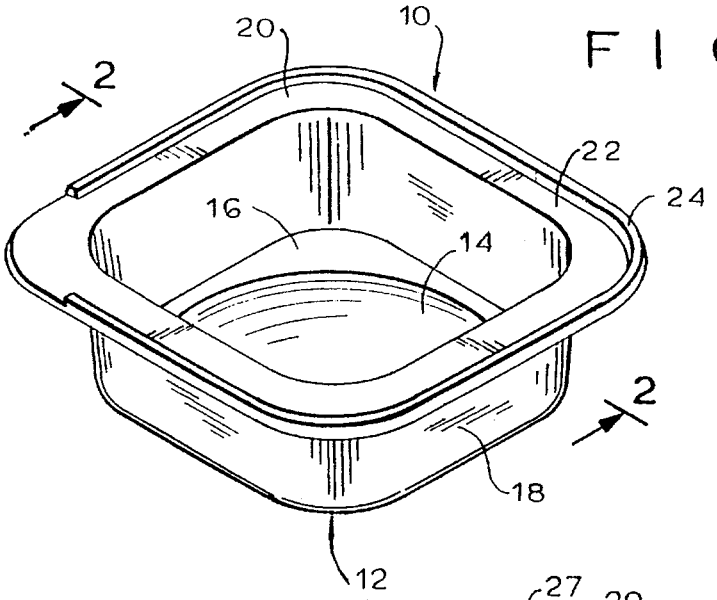
FIG. 1 is a front perspective view of a preferred embodiment of the container of this invention.

This invention relates to a method of filling and sealing a package with a product, and more particularly, to a method of producing an extended life package in which the integrity of the seal and the lid is preserved and the voids within the container that allow product movement are eliminated. Referring now to FIG. 1, a preferred embodiment of a container 10 is provided. The body 10 has a bottom 12 which has a flexible insert 14 substantially deformable in shape. Since the hoop stress provides for tension along the circumference of the container base, in the preferred embodiment, the container can be "bi-stable" in that it is stationary in either the up or down positions of the container. The base includes a deformable hoop webbing 16 between the insert 14 and the side edges 18 of the container. These rigid side edges 18 support an upper flange 20 which extends outwardly therefrom. The upper flange 20 includes a sealing surface 22 which terminates in a crimped raised rim section 24.

Figure 2:
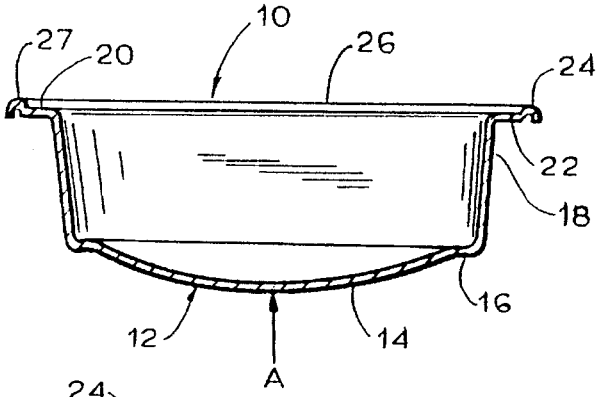
FIG. 2 is a side cross-sectional view taken along line 2—2 of FIG. 1 with the base of the container in its downward position.
Figure 3:
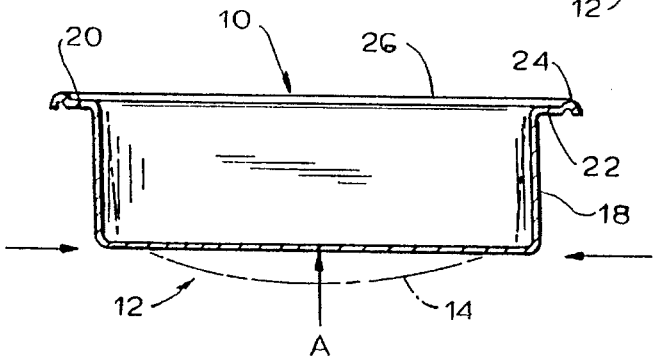
FIG. 3 is a side cross-sectional view taken along line 2—2 of FIG. 1 with the base of the container in its intermediate position.
Figure 4:
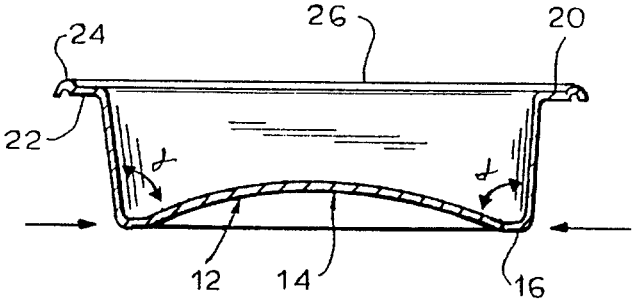
FIG. 4 is a side cross-sectional view taken along line 2—2 of FIG. 1 illustrating the base of the container in its upward position

As is best shown in FIG. 2, the container body is capable of receiving and-retaining a top cut lid 26 which is sealed to the container in the grooves 27 formed between the sealing surface 22 and the raised rim section 24. This lid is preferably formed of a puncture-resistant plastic material, but any material, including a nonplastic material, such as reinforced paper, which is substantially puncture-resistant may be utilized. As a force A (see FIG. 2), moves the base 12 upwardly, the outer rim or hoop member 16 of the base is stretched. As is illustrated in FIG. 3, the bending at the edges of the body induces stress to restore the body 10 to its original shape in the intermediate position of the deformable bottom. After a force A is applied to the container bottom, the bottom is inverted forming an inverted U shape (see FIG. 4). This angle $\alpha$ is decreased as the hoop stress of the hoop member 16 resists the bending stress around the base.

As a result of this design, the bottom is stable in either the up or down position, and as such, the bottom is bi-stable. Since the whole container is made of a semi-rigid material, the bottom is not a stretchable diaphragm. The base 12 is thus held stable in either position by the hoop stress of the outer diameter 16 of the base 12.

In another preferred embodiment of the deformable container of this invention, the container body may have a deformable bottom which is entirely deformable in shape. In this configuration, the base does not include a hoop member, such as 16 (see FIG. 1). The body of this preferred embodiment also includes semi-rigid side members which support an upper flange which extends outwardly from the side surfaces. The upper flange includes a sealing surface which terminates in the rim section. A force A applied to the container base, moves the base upwardly thereby stretching the outer rim of the base. In the intermediate stage, the side walls of the container are pushed outward as the base is inverted. The bending at the edges induces stress to restore the container to its original shape. When the base is in its final upward position, the hoop stress along the side edges resists this bending stress and holds the base stable in the up position.

In these or other embodiments, the containers may be manufactured with the base either up or down, provided the hoop stress induced in the outer diameter of the base can resist the restoring stresses, and can hold the base stable in the position opposite to the manufactured position.

A preferred method for filling and sealing these deformable containers is shown in FIGS. 5–9. Referring now to FIG. 5, the sealing surface 22 of the container body 10 is mounted on support arms 28 of an anvil 30. The cavity 32 of container body 10 is charged with a product 34 from a filler 36. This product charge is sufficiently fluid or malleable so that it will not tend to assume any specific natural shape, but however, will fill the void volume of the container with a secured lid. In this configuration, the container is filled with the insert 14 of the base 12 in its downwardly position. After the product has been initially charged into the container, there is still sufficient headspace, however, to permit lid placement without squeezing the top of the product fill onto the sealing surface (see FIG. 6).

Referring now to FIG. 7, the filled container supported on anvil 30 and lid are then transferred into a vacuum chamber 38. When the container and lid are initially transferred into the vacuum chamber, a sealing head 40 is disposed in the vacuum chamber immediately above anvil 30 in its raised position. In this position, the gas in the vacuum chamber 38 is evacuated through multiple ports 42*a, b* and *c*. Due to the force of the evacuation, an opening 44 is formed between lid 26 and sealing surface 22 of the container body 10, and as a result thereof, the pressure of the headspace air within the container is lowered to that of the vacuum chamber.

Figure 8:
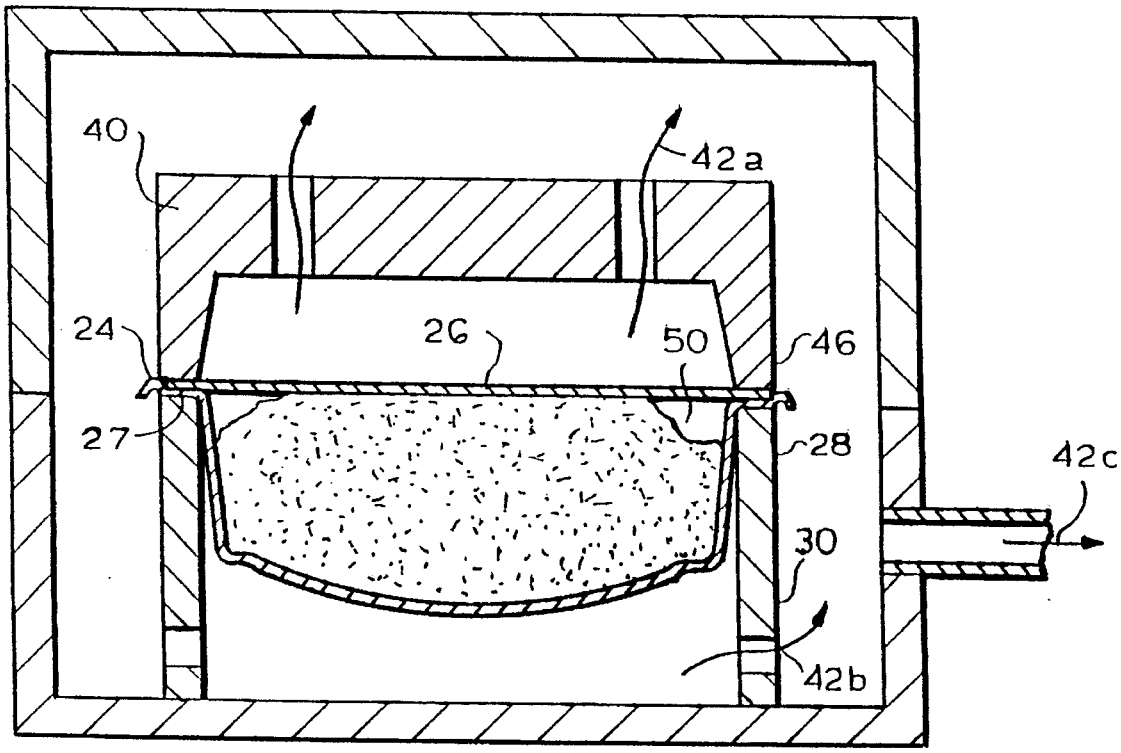

When the desired vacuum level is achieved within the chamber 38, and as such, gas has been exhausted through ports 42*a, b* and *c*, the seal head 40 is lowered and the lid 26 is sealed to the sealing surface 22 of the container body 10, as is shown in FIG. 8. Even though the preferred embodiment herein discloses that the lid may be heat sealed to the sealing surface 22 of container body 10, other methods of sealing may be utilized. These include induction sealing, spin welding, cold seal, ultrasonic sealing or seaming. The edges 46 of the seal head 40 apply pressure to the outward edges 48 of the continuous top lid 26 such that the outward edges 48 are closely confined to the sealing surface 22 of container body 10 (see FIG. 8). During this sealing process, the vacuum is maintained.

Figure 9:
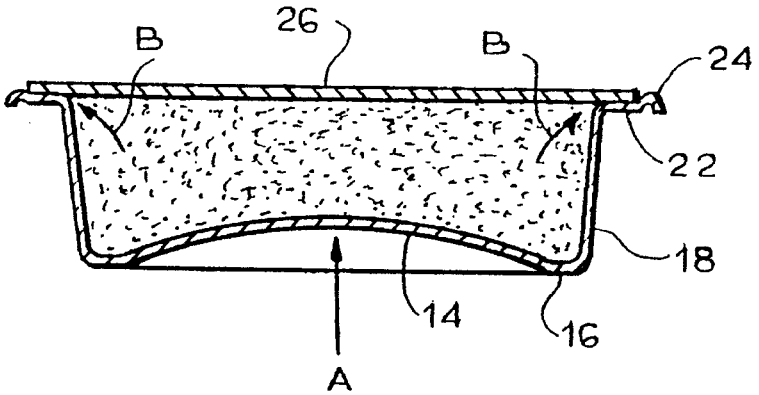

As is illustrated in FIG. 9, the container is removed from the vacuum chamber such that the container is brought back to atmospheric pressure. As a result thereof, the deformable insert 14 of base 12 is inverted upwardly, thereby forcing the product 34 in the direction of arrow B to fill the headspace and voids 50. The wet or dry products within the container must be sufficiently mobile to move into the voids. Since the product is forced into the voids 50 when the container is brought back to atmospheric pressure, the value impression of the product to the consumer is thereby improved. As a result thereof, such a method of filling and sealing a deformable container enables the fill volume to be less than the initial container volume to thereby isolate the product from the seal area to avoid seal area contamination. This process, however, also eliminates voids within the container which allow product movement.

While the preferred embodiment of the present invention has been described, it should be understood that various changes, adaptations and modifications may be made therein without departing from the spirit of the invention and the scope of the appended claims. For instance, the force A, as is shown in FIGS. 2, 3, and 8 may be caused by either the return to atmospheric pressure of the container after the vacuum environment is terminated or by a mechanical push. In addition, preferably the container body is hi-stable, i.e., the container is stable with the deformable insert being in either the up or down position. If, however, the container is not bi-stable, such that the deformable bottom will remain in the down position unless held up by a vacuum, or partial vacuum, within the container, a worker will then be able to recognize that a loss of sufficient vacuum occurred during filling. As a result thereof, the product should be rejected.

Figure 10:
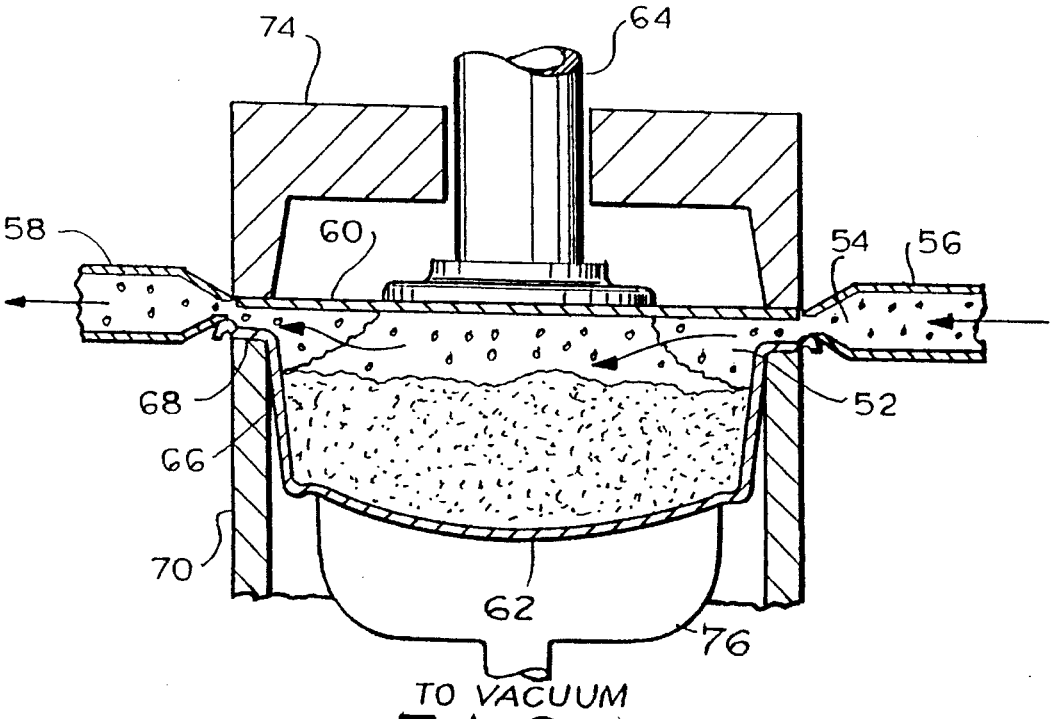
FIGS. 10 and 11 illustrate another preferred method of filling and sealing a deformable container utilizing a steam flushing process.
Figure 11:
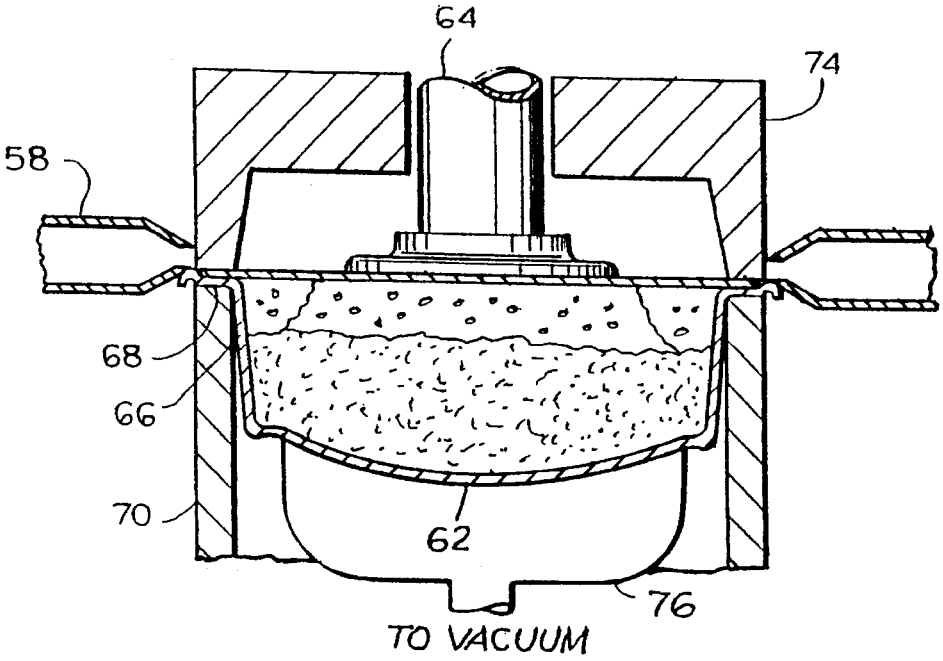

Additionally, this method may be utilized for steam flushing, as is shown in FIGS. 10 and 11, which is an important alternative for filling the container with a hot product. Without steam flushing, the vacuum maintained during the process would cause the hot product to boil. With this steam flushing process, the evacuation of the pack may be achieved by flushing out the headspace gas 52 (see FIG. 10) with steam 54 from a steam duct 56 just prior to sealing the lid. The steam exits the headspace through an extract duct 58. While the steam flushing is taking place, the lid 60 of container 62 is held above the container 62 by a lid holding device 64. As in the previous preferred embodiment, the sealing surface 66 of the container is mounted on support arms 68 of an anvil 70. Additionally, a sealing head 74 is in its raised position above the sealing surface of the container.

After the headspace gas is steam flushed, the sealing head is lowered and the lid is sealed to the sealing surface of the container body (see FIG. 11). This steam will then condense to water, on cooling, resulting in a vacuum within the container headspace. As in FIG. 9, the container is then subjected to atmospheric pressure to invert the container bottom into its upward position thereby forcing the product into close contact with the lid to thereby reduce the headspace between the product and the lid.

With steam flushing, it is possible to utilize a container that has a bottom which is stable only in the up position. This base can be held down with a vacuum suction cup such as 76 in FIGS. 10 and 11 during filling and sealing, then released to invert to its original and stable position aided by the vacuum induced by the steam flush. This container design, with its dome base stable in the up position, could be used with a vacuum chamber, but, in order to deform the bottom of the container downwardly, a mechanical gripper could engage any suitable attachment member extending from the container bottom.

It is intended that the appended claims be interpreted as including the foregoing as well as various other such changes and modifications.

What is claimed is:

1. A method of filling and sealing a bi-stable container, subjected to a gaseous environment, with a product and having a bottom deformable between stable upward and downward positions and having a hoop member surrounding the side edges of the container, said method comprising the steps of:

placing the container having an unribbed bottom upon an anvil;

charging the container with the unribbed bottom in its stable downward position with a product to a level having a volume less than the container volume but equal to the filled volume with such level defining a headspace opening;

maintaining the unribbed bottom in its downward position with a vacuum suction cup;

positioning a generally flat lid adjacent to a sealing surface;

placing the container in a position to be steam flushed;

flushing out the headspace gas with steam;

placing the container below a sealing head;

mounting the sealing surface of said container along a leading edge of said anvil;

lowering said sealing head such that the sealing head seals the lid to said sealing surface of said container;

allowing the headspace to cool, and condensing the steam to water resulting in a vacuum within the headspace;

maintaining the unribbed bottom of the base in its downward position with a vacuum suction cup;

releasing the vacuum suction cup from the base of the container and returning the container to atmospheric pressure wherein hoop stress of said hoop member resists the bending stress around said unribbed bottom such that the unribbed bottom is inverted to its stable upwardly extended position thereby forcing the product into close contact with said lid to reduce the headspace between said product and said lid and wherein said lid remains in its generally flat configuration.

2. A container, subjected to a gaseous environment, holding a product and having a bottom deformable in shape between downward and upward stable positions and having a hoop member surrounding the side edges of the container, said container being manufactured by the process comprising the steps of:

placing the container having an unribbed bottom in said stable downward position upon an anvil;

charging the container with its unribbed bottom in its downward position with the product having a volume less than the container volume but equal to the filled volume with such level defining a headspace opening;

maintaining the unribbed bottom in its downward position with a vacuum suction cup;

positioning a generally flat lid adjacent to a sealing surface;

placing the container in a position to be steam flushed;

flushing out the headspace gas with steam;

sealing said lid to said container;

allowing the headspace to cool, and condensing the steam to water resulting in a vacuum with the headspace;

maintaining the unribbed bottom of the base in its downward position with a vacuum suction cup;

releasing the vacuum suction cup from the base of the container and returning the container to atmospheric pressure wherein hoop stress of said hoop member resists the bending stress around said unribbed bottom such that the bottom of the container is inverted into its stable upwardly extended position thereby forcing the product into close contact with the lid to thereby reduce the headspace between the product and the lid and wherein the lid remains in its generally flat configuration.

* * * * *